United States Patent [19]

Meissner

[11] Patent Number: 4,701,079

[45] Date of Patent: Oct. 20, 1987

[54] PIVOT CONNECTIONS FOR USE WITH MINE ROOF SUPPORTS

[75] Inventor: Horst Meissner, Bergkamen-Oberaden, Fed. Rep. of Germany

[73] Assignee: Gewerkschaft Eisenhutte Westfalia, Lunen, Fed. Rep. of Germany

[21] Appl. No.: 900,978

[22] Filed: Aug. 27, 1986

[30] Foreign Application Priority Data

Sep. 5, 1985 [DE] Fed. Rep. of Germany ..... 3531668

[51] Int. Cl.[4] ..... E21D 19/00

[52] U.S. Cl. ..... 405/296; 405/291; 405/295; 403/154; 403/163

[58] Field of Search ..... 405/295, 296; 403/154, 403/161, 163, 315, 316, 317, 345, 376, 405.1, 410, 324; 74/526

[56] References Cited

U.S. PATENT DOCUMENTS

| | | | |
|---|---|---|---|
| 2,847,238 | 8/1958 | Bolling, Jr. | 403/154 |
| 3,233,930 | 2/1966 | Becker | 403/163 |
| 3,885,396 | 5/1975 | Snowden et al. | 405/296 |
| 4,236,850 | 12/1980 | Koppers et al. | 405/295 |
| 4,252,477 | 2/1981 | Bollmann | 405/295 |
| 4,293,247 | 10/1981 | Rosenberg et al. | 405/295 |
| 4,382,722 | 5/1983 | Romanowicz et al. | 405/295 |
| 4,389,135 | 6/1983 | Peters | 403/163 |
| 4,477,202 | 10/1984 | Price | 403/324 |
| 4,548,587 | 10/1985 | Slattery | 403/154 |
| 4,607,986 | 8/1986 | Brown | 405/295 |

*Primary Examiner*—Dennis L. Taylor

*Attorney, Agent, or Firm*—Samuels, Gauthier Stevens & Kehoe

[57] ABSTRACT

A mine roof support has gap seals in the form of L-shaped plates on its roof cap and goaf shield. The side walls of the plates overlap at the junctures between the roof cap and goaf shield and are connected with pivot connections each of which is composed of a pin inserted into apertures in the side walls of the plates. The pin has a peripheral groove at its inner end region which receives an arcuate yoke plate serving as a support. The yoke plate is itself detachably secured in place with a releasable rod permitting the pivot connection to be easily dismantled.

9 Claims, 3 Drawing Figures

PIVOT CONNECTIONS FOR USE WITH MINE ROOF SUPPORTS

FIELD OF THE INVENTION

The present invention relates in general to mine roof supports of the type comprising a roof cap supported on a floor sill with the aid of hydraulic props and a goaf shield pivotably connected to the roof cap.

BACKGROUND OF THE INVENTION

In a roof support of the aforementioned kind, it is known to provide gap seals in the form of L-shaped plates on the roof cap and goaf shield. These plates are usually flexibly adjustable laterally of the support so that the side walls thereof engage side walls of adjacent roof supports to seal off the gaps between the caps and goaf shields to provide a screen between the working or access zone and the stowage or rubble zone of the mine working. German Patent Specification No. P28 53 050 describes such an arrangement. In the region where the goaf shield of the support meets the roof cap the side walls of the gap sealing plates overlap one another and it is known to interconnect the overlapping walls with pivot joints to permit the gap sealing plates to follow pivotable movements between the shield and the roof gap. Hitherto these pivot joints have been detachably secured in position with the aid of a locking plate fixed position with screws. The accessibility of the screws is poor and the screws are prone to become jammed with rust, especially in the harsh environment in a typical mine working.

A general object of the present invention is to provide an improved pivot connection for linking the overlapping side walls of the gap sealing plates.

SUMMARY OF THE INVENTION

A pivot or hinge connection constructed in accordance with the invention has a pivot pin engaging through apertures in the side walls of the overlapping side walls of the gap sealing plates of the roof engaging structure or cap and the goaf shield of the roof suppprt. The inner end of the pin which projects inwardly beyond the innermost side wall if provided with a peripheral groove. This groove receives support means in the form of a plate shaped as an arcuate yoke which is detachably secured in position with locking means in the form of a rod, conveniently a plain pin, which can be easily withdrawn from apertures of a bearing structure or trunnion bearing. The hinge pin is thus located without screws and can be dismantled and assembled quite easily in situ. The construction is however robust and the connection is able to cope with the forces encountered during operation of the roof support.

Conveniently, the plate forming the arcuate yoke extends partly around the hinge pin and is combined with a depending stem or shank to form a integral component constituting the support means which is mountable to engage the yoke plate in the groove from beneath the pin. The stem can project alongside the locking pin and in this case a stop member shaped as a lever or handle fitted to the stem can abut on the locking pin. The locking pin engages through apertures in some other bearing structure and when withdrawn from the apertures the support means can simply fall out of the groove to permit the hinge pin to be withdrawn. Cotter pins or the like can secure the locking pin to the bearing structure. The hinge pin itself may have a through bore to facilitate its handling during assembly and dismantling. The release and assembly of the pivot connection can be effected from the working zone adjacent the mineral face.

The invention may be understood more readily and various other features and aspects of the invention may become apparent, from consideration of the following description.

BRIEF DESCRIPTION OF THE DRAWINGS

An embodiment of the invention will now be described, by way of example only, with reference to the accompanying drawings, wherein.

DESCRIPTION OF PREFERRED EMBODIMENT

Figure 1:
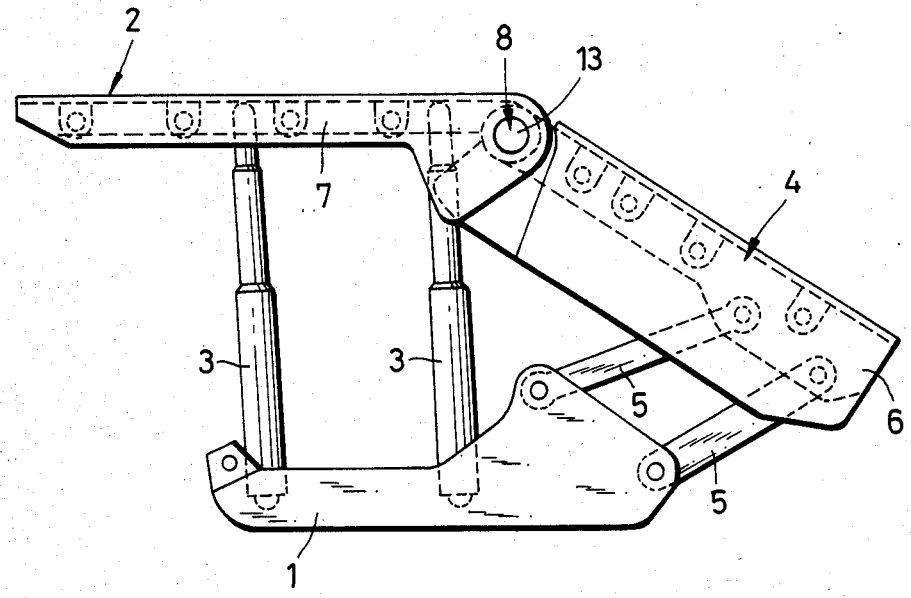
FIG. 1 is a schematic side view of a roof support constructed in accordance with the invention.

As shown in FIG. 1, roof support is composed, in known manner, of a roof engaging structure 1, a roof engaging structure cap 2 and hydraulic props 3 articulated between the respective structures 1, 2. A goaf shield 4 is pivotably connected to the rear end of the roof engaging structure 2 and a system of guide levers 5 forming a lemniscate linkage connect the shield 4 to the floor engaging structure 1. The roof engaging structure 2 and the goaf shield 4 are provided with gap seals in the form of L-shaped plates 6, 7. One top section or wall of each plate 6, 7 extends laterally of the shield 4 or roof cap 2 and the other side section or wall projects from the top wall towards the floor of the working. As is known the plates 6, 7 are adjustable laterally of the support, i.e. perpendicular to FIG. 1 and are rendered resiliently flexible laterally of the support to engage with their side walls the side walls of adjacent roof supports to screen off the goaf or stowage zone from the working or access zone in the mine working. Springs and/or hydraulic rams can adjust the sealing plates 6, 7 in the manner described in German Patent Specification No. P28 53 050.

In the regions of the juncture between the roof cap 2 and the goaf shield 4 the side walls of the sealing plates 6, 7 overlap and in accordance with the invention pivot joints or connections 8 are provided between the overlapping side walls so that these side walls of the plates 6, 7 can be laterally displaced together for adjustment but follow any pivot movement between the roof cap 2 and the goaf shield 4.

Figure 2:
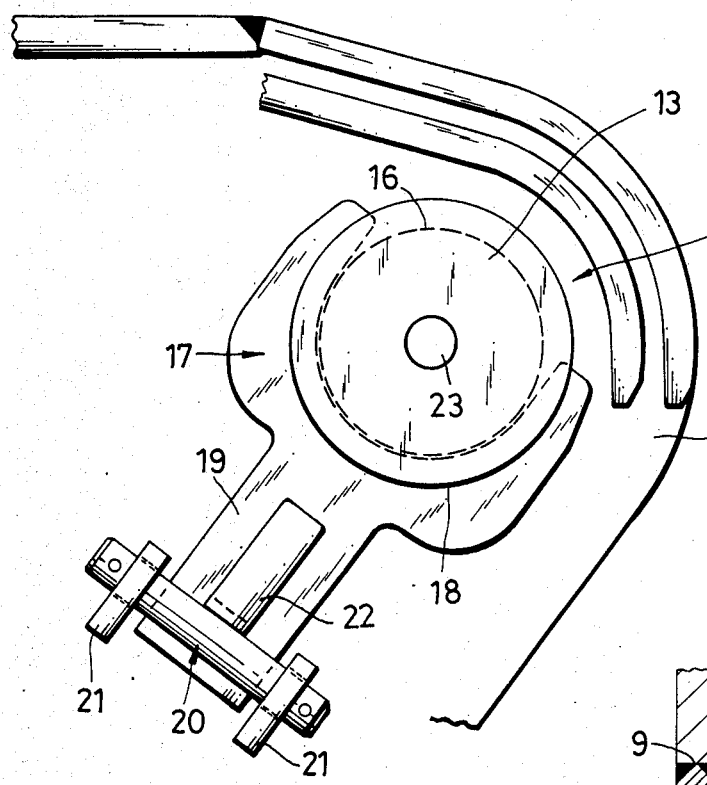
FIG. 2 is a schematic side view of part of the support showing a pivot connection thereof on a somewhat larger scale to that of FIG. 1.
Figure 3:
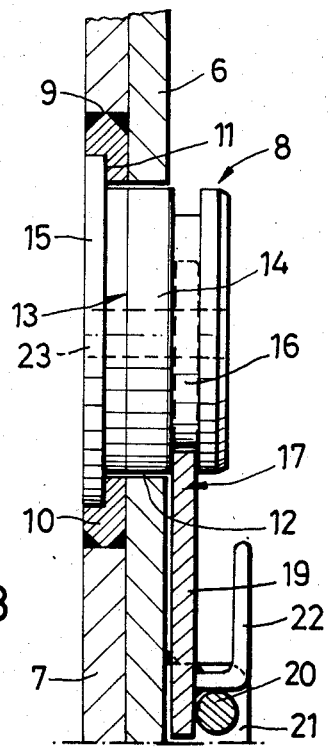
FIG. 3 is a part-sectional front view of the pivot connection depicted in FIG. 2.

FIGS. 2 and 3 depict one of the pivot connections 8 in detail. As shown the side wall of the plate 7 is disposed outside the side wall of the plate 6. A bearing ring 10 is welded into a circular aperture 9 in the side wall of the plate 7. The ring 10 has a recess 11. The side wall of the plate 6 has an aperture 12 aligned with the inner periphery of the ring 10. A cylindrical component 13 which forms a pivot pin 14 locates in the bearing ring 10 and the aperture 12 and the component 13 has a flange 15 engaging in the recess 11 of the ring 10. The component 13 projects inwardly beyond the side wall of the plate 6 and the inwardly projecting portion of the component 13 has a groove 16 which receives an arcuate or segmental shaped yoke plate 17 with a thickness slightly smaller than the groove 16. As shown in FIG. 2 the yoke plate 17 has an inner surface 18 which extends at least half way around the groove 16. The yoke plate 17 connects with a shank 19 extending radially of the component 13 which has a stop member 22 engaging on a withdrawable rod forming a locking pin 20. The locking pin 20 is releasably secured to an apertured trunnion bearing 21 forming a bearing structure for the support 17, 19, 22 with cotter pins or the like. To assemble the hinge or pivot connection the component 13 is inserted through the apertures in the side walls of the plates 6, 7 until its flange 15 engages in the recess 11. The yoke plate 17 is then mounted from the inside to lock into the groove 16. The free end of the shank 19 is engaged behind the pin 20 as shown in FIG. 2 to cause the stop member 22 to rest on the pin 20 and retain the support 17, 19, 22 in place.

To dismantle the hinge connection 8, the bolt 20 is withdrawn from the trunnion bearing 21 and the yoke plate 17 drops or is moved out of the groove 16 to permit the component 13 to be withdrawn. The component 13 preferably has an axial bore 23 as shown which assists in the assembly and dismantling operations e.g. a tool can be introduced into the bore 23. The stop member 22 is preferably also shaped as a lever or handle as an aid to handling.

FIGS. 1 and 2 show the shank 19, usually integral with the yoke plate 17 and which is fitted in the groove 16 from below, to be directed generally downwardly towards the floor of the working. The shank 19 or equivalent can however be directed obliquely towards the mineral face, for example, to permit better access for the assembly and dismantling operation.

The above-described embodiment is notably of simple construction requiring no special parts and avoids the use of screws or the like which can become jammed and is robust and reliable in operation.

I claim:

1. In a mine roof support comprising a roof engaging structure, a floor engaging structure, one or more hydraulic props disposed between the roof and floor engaging structures, a goaf shield, means pivotably interconnecting the goaf shield to the roof and floor engaging structures, gap seals in the form of L-shaped plates displaceably mounted on the goaf shield and the roof-engaging structure, said plates having side walls which overlaps in the regions where the goaf shield and the roof engaging structure are interconnected and a pivot connection between the overlapping side walls and the plates; the improvement comprising the pivot connection is composed of aligned apertures in the overlapping side walls, a pivot pin engaged through said apertures, a peripheral groove formed in an inner end region of the pivot pin relative to the support, support means including an arcuate yoke engaging in the groove and releasable locking means for securing the support means in position.

2. A support according to claim 1, wherein the arcuate yoke is a plate and the support means further comprises an integral shank depending from the yoke plate for location with the locking means.

3. A support according to claim 1, and further comprising a bearing structure with apertures receiving a withdrawable pin forming the locking means.

4. A support according to claim 3, wherein the withdrawable pin is releasably fixed in the apertures with the aid of cotter pins extending transversely of the withdrawable pin.

5. A support according to claim 3, wherein the shank is connected to a stop member which abuts the withdrawable pin and the shank projects alongside said withdrawable pin.

6. A support according to claim 5, wherein the stop member forms a handle.

7. A support according to claim 1, wherein the pivot pin is provided with a through bore.

8. A support according to claim 1, wherein at least one of the apertures in the side walls is lined with a recessed bearing ring and the pivot pin has a flange which fits into the access of the bearing ring.

9. In a mine roof support comprising a roof engaging structure, a floor engaging structure, one or more hydraulic props disposed between the roof and floor engaging structures, a goaf shield, means pivotably interconnecting the goaf shield to the roof and floor engaging structures, gap seals in the form of L-shaped plates displaceably mounted on the goaf shield and the roof-engaging structure, said plates having side walls which overlaps in the regions where the goaf shield and the roof engaging structure are interconnected, and a pivot connection between the overlapping side walls and the plates; the improvement comprising the pivot connection being composed of: aligned apertures in the overlapping side walls, a pivot pin engaged through said apertures, a peripheral groove formed in an inner end region of the pivot pin relative to the support, support means including an arcuate yoke engaging in the groove and having a shank member connected to a stop member in the form of a handle, and releasable locking means for securing the support means in position, said locking means comprising a bearing structure with apertures receiving a withdrawable locking pin lying alongside said shank at a location abutting said stop member.

* * * * *